US009422689B2

(12) United States Patent
Wu

(10) Patent No.: US 9,422,689 B2
(45) Date of Patent: Aug. 23, 2016

(54) SHOVEL AND METHOD FOR CONTROLLING SHOVEL

(71) Applicant: SUMITOMO HEAVY INDUSTRIES, LTD., Tokyo (JP)

(72) Inventor: Chunnan Wu, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 330 days.

(21) Appl. No.: 14/140,863

(22) Filed: Dec. 26, 2013

(65) Prior Publication Data

US 2014/0102289 A1 Apr. 17, 2014

Related U.S. Application Data

(63) Continuation of application No. PCT/JP2012/067233, filed on Jul. 5, 2012.

(30) Foreign Application Priority Data

Jul. 6, 2011 (JP) ..... 2011-150372

(51) Int. Cl.
*E02F 3/42* (2006.01)
*E02F 9/20* (2006.01)
(Continued)

(52) U.S. Cl.
CPC ..... *E02F 3/425* (2013.01); *E02F 3/435* (2013.01); *E02F 9/2075* (2013.01); *E02F 9/2091* (2013.01); *E02F 9/2217* (2013.01); *E02F 9/2282* (2013.01); *E02F 9/2285* (2013.01); *E02F 9/2292* (2013.01); *E02F 9/2296* (2013.01); *F15B 21/14* (2013.01); *F15B 2211/20546* (2013.01); *F15B 2211/20576* (2013.01); *F15B 2211/3116* (2013.01); *F15B 2211/7053* (2013.01); *F15B 2211/71* (2013.01); *F15B 2211/88* (2013.01)

(58) Field of Classification Search
CPC ..... F15B 21/14; F15B 2211/88; E02F 9/2217
USPC ..... 60/414, 421, 436
See application file for complete search history.

(56) References Cited

U.S. PATENT DOCUMENTS 6,151,894 A * 11/2000 Endo et al. ..... 60/414
6,502,393 B1 * 1/2003 Stephenson et al. ..... 60/414
(Continued)

FOREIGN PATENT DOCUMENTS

EP 1571352 9/2005
EP 1790781 5/2007
(Continued)

OTHER PUBLICATIONS

International Search Report mailed on Sep. 11, 2012.

*Primary Examiner* — Thomas E Lazo
(74) *Attorney, Agent, or Firm* — IPUSA, PLLC

(57) ABSTRACT

A shovel according to an embodiment of the present invention is a shovel including a boom cylinder and an arm cylinder. The shovel includes a hydraulic motor driven by hydraulic oil flowing out of the boom cylinder, a regenerating oil passage configured to supply the hydraulic oil flowing out of the boom cylinder to the hydraulic motor, a reusing oil passage configured to supply the hydraulic oil flowing out of the boom cylinder to the arm cylinder, and a reusing flow control valve configured to control a flow rate of hydraulic oil flowing in the reusing oil passage.

9 Claims, 10 Drawing Sheets

(51) Int. Cl.

| | |
|---|---|
| ***E02F 9/22*** | (2006.01) |
| ***E02F 3/43*** | (2006.01) |
| *F15B 21/14* | (2006.01) |

(56) References Cited

U.S. PATENT DOCUMENTS

| | | | | |
|---|---|---|---|---|
| 7,086,226 | B2 * | 8/2006 | Oguri | 60/414 |
| 7,562,472 | B2 * | 7/2009 | Tozawa et al. | 37/348 |
| 2002/0162251 | A1 * | 11/2002 | Underwood | 37/403 |
| 2005/0036894 | A1 | 2/2005 | Oguri | |
| 2005/0246082 | A1 * | 11/2005 | Miki et al. | 701/50 |
| 2009/0288408 | A1 | 11/2009 | Tozawa et al. | |

FOREIGN PATENT DOCUMENTS

| | | |
|---|---|---|
| EP | 2754758 | 7/2014 |
| JP | 2006-336433 | 12/2006 |
| JP | 2008-045575 | 2/2008 |
| JP | 2008-202343 | 9/2008 |
| JP | 2008-275101 | 11/2008 |
| JP | 2010-281183 | 12/2010 |

* cited by examiner

SHOVEL AND METHOD FOR CONTROLLING SHOVEL

RELATED APPLICATIONS

This is a continuation of International Patent Application No. PCT/JP2012/067233, filed on Jul. 5, 2012 which is based on and claims the benefit of priority of Japanese Patent Application No. 2011-150372, filed on Jul. 6, 2011, the entire contents of each of which are incorporated herein by reference.

BACKGROUND

1. Technical Field

The present invention is related to a shovel including a boom regenerative hydraulic motor and a method for controlling the shovel.

2. Description of Related Art

Until now, a hybrid type shovel including an electric motor generator for a boom, an electric motor generator for an engine, and an electric motor generator for a swing body is known. The boom-driving electric motor generator is rotationally driven by a boom regenerative hydraulic motor when lowering a boom. The electric motor generator for an engine is rotationally driven by an engine. The electric motor generator for a swing body is capable of a regenerating operation and a power running operation.

This hybrid type shovel shifts the electric motor generator for an engine to its power running operation when the electric motor generator for a boom or the electric motor generator for a swing body is in its regenerative operation. Thus, the hybrid type shovel can use regenerated electric power for driving the electric motor generator for an engine without charging a battery, and thus can make more efficient use of the regenerated electric power.

SUMMARY

A shovel according to an embodiment of the present invention is a shovel including hydraulic actuators including a boom cylinder. The shovel includes a hydraulic motor driven by hydraulic oil flowing out of the boom cylinder, a regenerating oil passage configured to supply the hydraulic oil flowing out of the boom cylinder to the hydraulic motor, a reusing oil passage configured to supply the hydraulic oil flowing out of the boom cylinder to another hydraulic actuator, and a reusing flow control valve configured to control a flow rate of hydraulic oil flowing in the reusing oil passage.

Also, a method for controlling a shovel according to an embodiment of the present invention is a method for controlling a shovel including hydraulic actuators including a boom cylinder. The method includes steps of driving a hydraulic motor by using hydraulic oil flowing out of the boom cylinder, supplying the hydraulic oil flowing out of the boom cylinder to the hydraulic motor, supplying the hydraulic oil flowing out of the boom cylinder to another hydraulic actuator through a reusing oil passage, and controlling a flow rate of hydraulic oil flowing in the reusing oil passage by using a reusing flow control valve.

DETAILED DESCRIPTION

The above known hybrid type shovel makes use of hydraulic oil flowing out of a boom cylinder for driving the boom regenerative hydraulic motor, and then does nothing other than draining the hydraulic oil to an oil tank. Thus, there is a room for improvement in making more efficient use of energy.

In view of the above, it is desirable to provide a shovel making more efficient use of hydraulic oil flowing out of a boom cylinder when lowering a boom, and a method for controlling the shovel.

Figure 1:
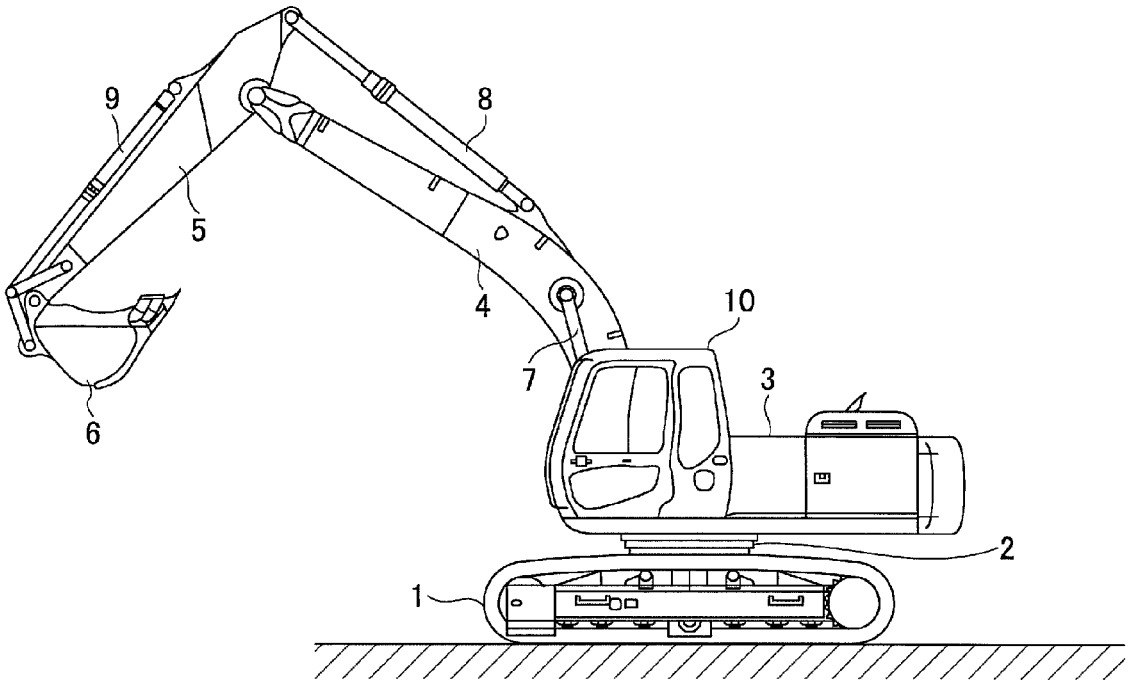
FIG. 1 is a side view of a hybrid type shovel according to an embodiment of the present invention.

FIG. 1 is a side view showing a hybrid type shovel to which an embodiment of the present invention is applied.

On a lower travel body 1 of the hybrid type shovel, an upper swing body 3 is mounted via a swing mechanism 2. A boom 4 is attached to the upper swing body 3. An arm 5 is attached to an end of the boom 4. A bucket 6 is attached to an end of the arm 5. The boom 4, arm 5, and bucket 6 are hydraulically driven by a boom cylinder 7, an arm cylinder 8, and a bucket cylinder 9, respectively. On the upper swing body 3, a cabin 10 is installed, and a drive source such as an engine or the like is mounted.

Figure 2:
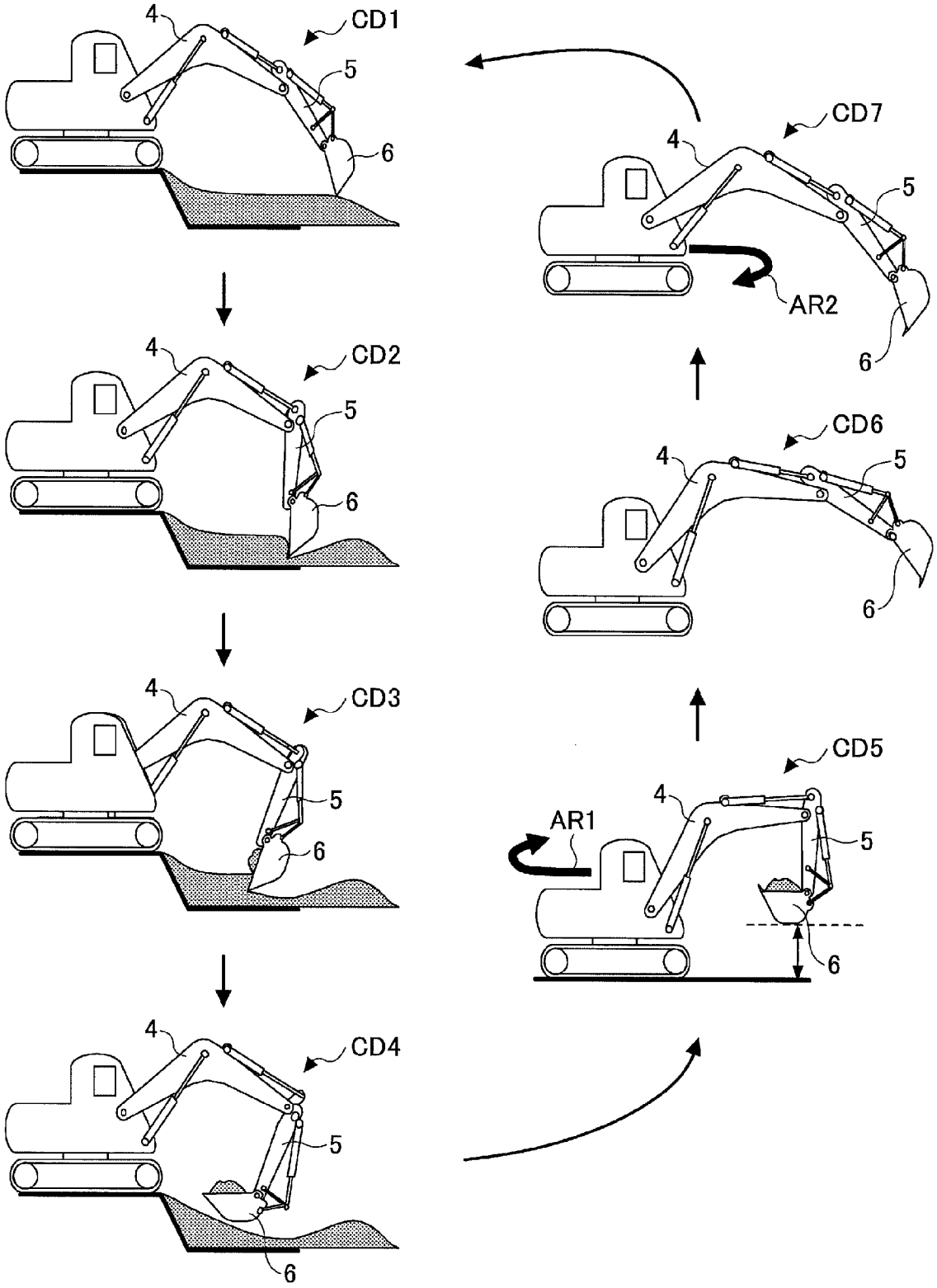
FIG. 2 is a diagram showing transition of operating states of the hybrid type shovel according to an embodiment of the present invention.

Next, referring to FIG. 2, excavating/loading operation will be explained as an example of operations of the hybrid type shovel. First, as shown in a state CD1, an operator manipulates the shovel to swing the upper swing body 3, to locate the bucket 6 above a position to be excavated, to open the arm 5, and to open the bucket 6. At the state, the operator manipulates the shovel to lower the boom 4, and to lower the bucket 6 so that a tip of the bucket 6 is located at a desired height from an object to be excavated. Typically, when swinging the upper swing body 3 and when lowering the boom 4, the operator visually confirms a position of the bucket 6. Also, it is common that swinging the upper swing body 3 and lowering the boom 4 are performed simultaneously. The above operation is referred to as a boom lowering swinging operation, and this operation phase is referred to as a boom lowering swinging operation phase.

If the operator judges that a tip of the bucket 6 has reached a desired height, the operator manipulates the shovel to close the arm 5 until the arm 5 becomes nearly perpendicular to a ground surface as shown in a state CD2. In this way, a soil at a certain depth is excavated and scraped by the bucket 6 until the arm 5 becomes nearly perpendicular to the ground surface. Next, the operator manipulates the shovel to further close the arm 5 and the bucket 6 as shown in a state CD3, and then to close the bucket 6 until the bucket 6 becomes nearly perpendicular to the arm 5 as shown in a state CD4. That is, the operator manipulates the shovel to close the bucket 6 until an upper edge of the bucket 6 becomes nearly horizontal to scoop the scraped soil into the bucket 6. The above operation is referred to as an excavating operation, and this operation phase is referred to as an excavating operation phase.

Next, if the operator judges that the bucket 6 has been closed until the bucket 6 becomes nearly perpendicular to the arm 5, the operator manipulates the shovel to lift the boom 4 while closing the bucket 6 until a bottom of the bucket 6 reaches a desired height from the ground surface as shown in a state CD5. This operation is referred to as a boom lifting operation, and this operation phase is referred to as a boom lifting operation phase. Following this operation, or simultaneously, the operator manipulates the shovel to swing the upper swing body 3 to move the bucket 6 in a circular motion to a position for dumping as shown by an arrow AR1. This operation including the boom lifting operation is referred to as a boom lifting swinging operation, and this operation phase is referred to as a boom lifting swinging operation phase.

The reason why the operator manipulates the shovel to lift the boom 4 until the bottom of the bucket 6 reaches the desired height is that, for example, the bucket 6 collides with a truck bed of a dump truck unless the bucket 6 is lifted above the truck bed when dumping the soil onto the truck bed.

Next, if the operator judges that the boom lifting swinging operation has been completed, the operator manipulates the shovel to dump the soil in the bucket 6 by opening the arm 5 and bucket 6 while lowering the boom 4 as shown in a state CD6. This operation is referred to as a dumping operation, and this operation phase is referred to as a dumping operation phase.

Next, if the operator judges that the dumping operation has been completed, the operator manipulates the shovel to swing the upper swing body 3 in a direction indicated by an arrow AR2 and to move the bucket 6 to a position immediately above the position to be excavated as shown in a state CD7. At this time, the operator manipulates the shovel to lower the boom 4 simultaneously with swinging the upper swing body 3 to lower the bucket 6 to a desired height from an object to be excavated. This operation is a part of the boom lowering swinging operation explained with the state CD1. Subsequently, the operator manipulates the shovel to lower the bucket 6 to the desired height as shown in the state CD1 to perform the excavating operation and following operations again.

The above described "boom lowering swinging operation", "excavating operation", "boom lifting swinging operation", and "dumping operation" constitute a cycle. The operator goes on with the excavating/loading operation while performing this cycle repeatedly.

Figure 3:
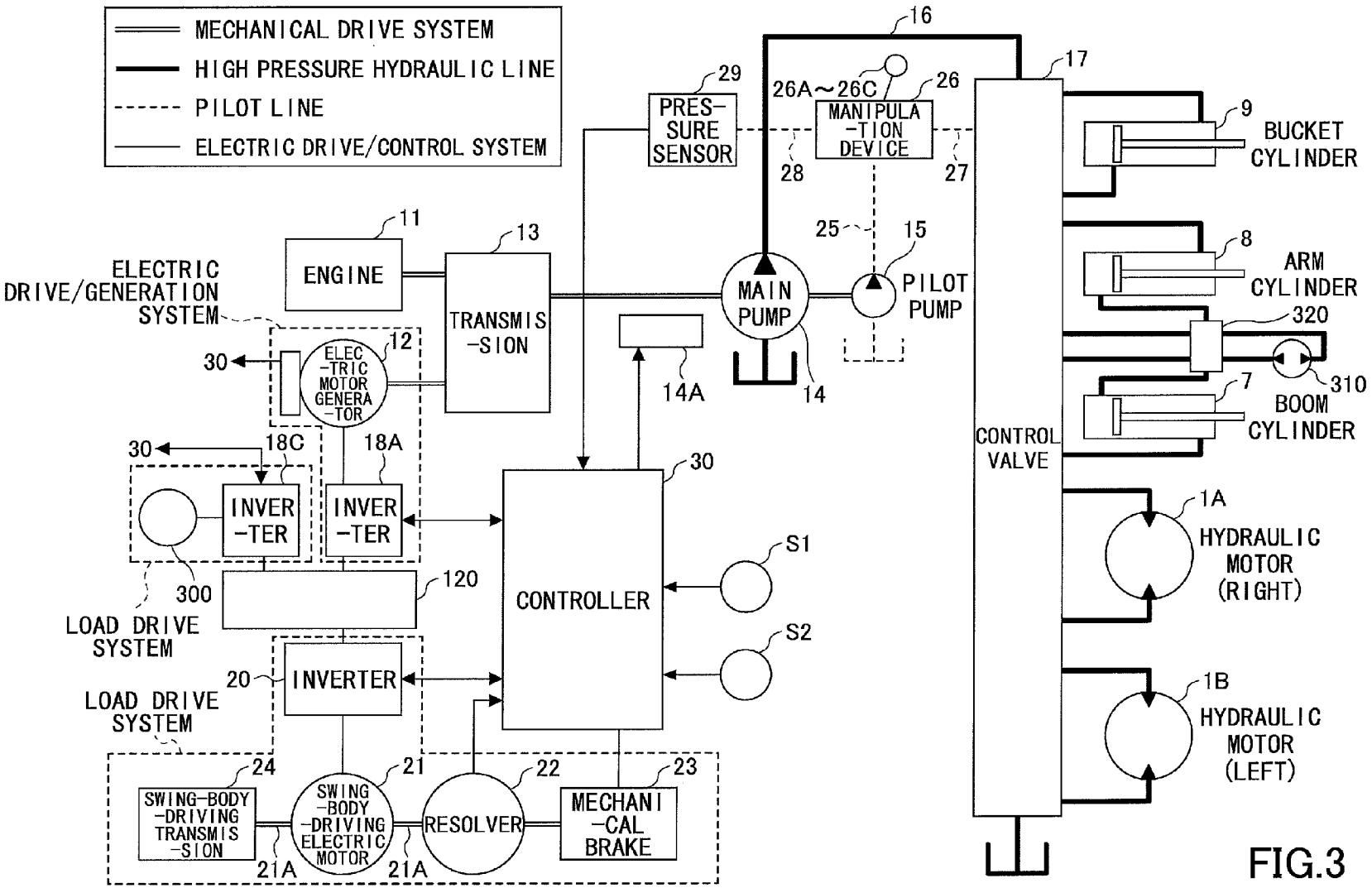
FIG. 3 is a block diagram showing a configuration example of a drive system of the hybrid type shovel according to an embodiment of the present invention.

FIG. 3 is a block diagram showing a configuration example of a drive system of a hybrid type shovel according to an embodiment of the present invention. FIG. 3 indicates a mechanical drive system by a double line, a high pressure hydraulic line by a thick solid line, a pilot line by a dashed line, and an electric drive/control system by a thin solid line.

An engine 11 as a mechanical drive part and an electric motor generator 12 as an assist drive part are connected to two input shafts of a transmission 13, respectively. An output shaft of the transmission 13 is connected to a main pump 14 and a pilot pump 15 as hydraulic pumps. The main pump 14 is connected to a control valve 17 via a high pressure hydraulic line 16.

A regulator 14A is configured to control a discharge rate of the main pump 14. For example, the regulator 14A controls a discharge rate of the main pump 14 by adjusting a swash plate tilt angle of the main pump 14 depending on a discharge pressure of the main pump 14, a control signal from the controller 30, or the like.

The control valve 17 is configured to control a hydraulic system mounted on the hybrid type shovel. The hydraulic motors 1A (for right) and 1B (for left) for the lower travel body 1, the boom cylinder 7, the arm cylinder 8, and the bucket cylinder 9 are connected to the control valve 17 via high pressure hydraulic lines. Hereinafter, the hydraulic motors 1A (for right) and 1B (for left) for the lower travel body 1, the boom cylinder 7, the arm cylinder 8, and the bucket cylinder 9 are referred to collectively as hydraulic actuators.

The electric motor generator 12 is connected to an electric energy storage system 120 including a capacitor as an electric energy storage device via an inverter 18A. The electric energy storage system 120 is connected to a swing-body-driving electric motor 21 as an electrically-driven work element via an inverter 20. A rotary shaft 21A of the swing-body-driving electric motor 21 is connected to a resolver 22, a mechanical brake 23, and a swing-body-driving transmission 24. The pilot pump 15 is connected to a manipulation device 26 via a pilot line 25. The swing-body-driving electric motor 21, the inverter 20, the resolver 22, the mechanical brake 23, and the swing-body-driving transmission 24 constitute a first load drive system.

The manipulation device 26 includes a lever 26A, a lever 26B, and a pedal 26C. Each of the lever 26A, the lever 26B, and the pedal 26C is connected to the control valve 17 and the pressure sensor 29 via hydraulic lines 27 and 28, respectively. The pressure sensor 29 is configured to function as an operating condition detecting part to detect each operating condition of the hydraulic actuators. The pressure sensor 29 is connected to the controller 30 that performs drive control of an electric system.

Also, in this embodiment, a boom-regenerating electric generator 300 for obtaining boom regenerative electric power is connected to the electric energy storage system 120 via an inverter 18C. The electric generator 300 is driven by a hydraulic motor 310 driven by hydraulic oil flowing out of the boom cylinder 7. The electric generator 300 converts potential energy of the boom 4 (hydraulic energy of the hydraulic oil flowing out of the boom cylinder 7) into electric energy by using pressure of the hydraulic oil flowing out of the boom cylinder 7 when the boom 4 descends under its own weight. FIG. 3 shows that the hydraulic motor 310 and the electric generator 300 are positioned away from each other for the purpose of illustration. However, in practice, a rotary shaft of the electric generator 300 is mechanically connected to a rotary shaft of the hydraulic motor 310. That is, the hydraulic motor 310 is configured to be rotated by the hydraulic oil flowing out of the boom cylinder 7 when the boom 4 descends, and installed to convert the hydraulic energy of the hydraulic oil into rotational force when the boom 4 descends under its own weight.

The electric power generated by the electric generator 300 is supplied as regenerative electric power to the electric energy storage system 120 via the inverter 18C. The electric generator 300 and the inverter 18C constitute a second load drive system.

In this embodiment, a boom cylinder pressure sensor S1 is attached to the boom cylinder 7, and an arm cylinder pressure sensor S2 is attached to the arm cylinder 8. The boom cylinder pressure sensor S1 detects hydraulic oil pressure in a bottom-side oil chamber of the boom cylinder 7. The arm cylinder pressure sensor S2 detects hydraulic oil pressure in a rod-side oil chamber of the arm cylinder 8. Each of the boom cylinder pressure sensor S1 and the arm cylinder pressure sensor S2 is an example of a hydraulic actuator pressure detecting part, and outputs a detected pressure value to the controller 30.

A communication circuit 320 is a hydraulic circuit configured to control a supply destination of the hydraulic oil flowing out of the boom cylinder 7. For example, the communication circuit 320 supplies all or a part of the hydraulic oil flowing out of the boom cylinder 7 to the arm cylinder 8 in response to the control signal from the controller 30. Also, the communication circuit 320 may supply all of the hydraulic oil flowing out of the boom cylinder 7 to the hydraulic motor 310. Alternatively, the communication circuit 320 may supply a part of the hydraulic oil flowing out of the boom cylinder 7 to the arm cylinder 8 and may supply the remaining part to the hydraulic motor 310. Operations of the communication circuit 320 will be explained below.

Figure 4:
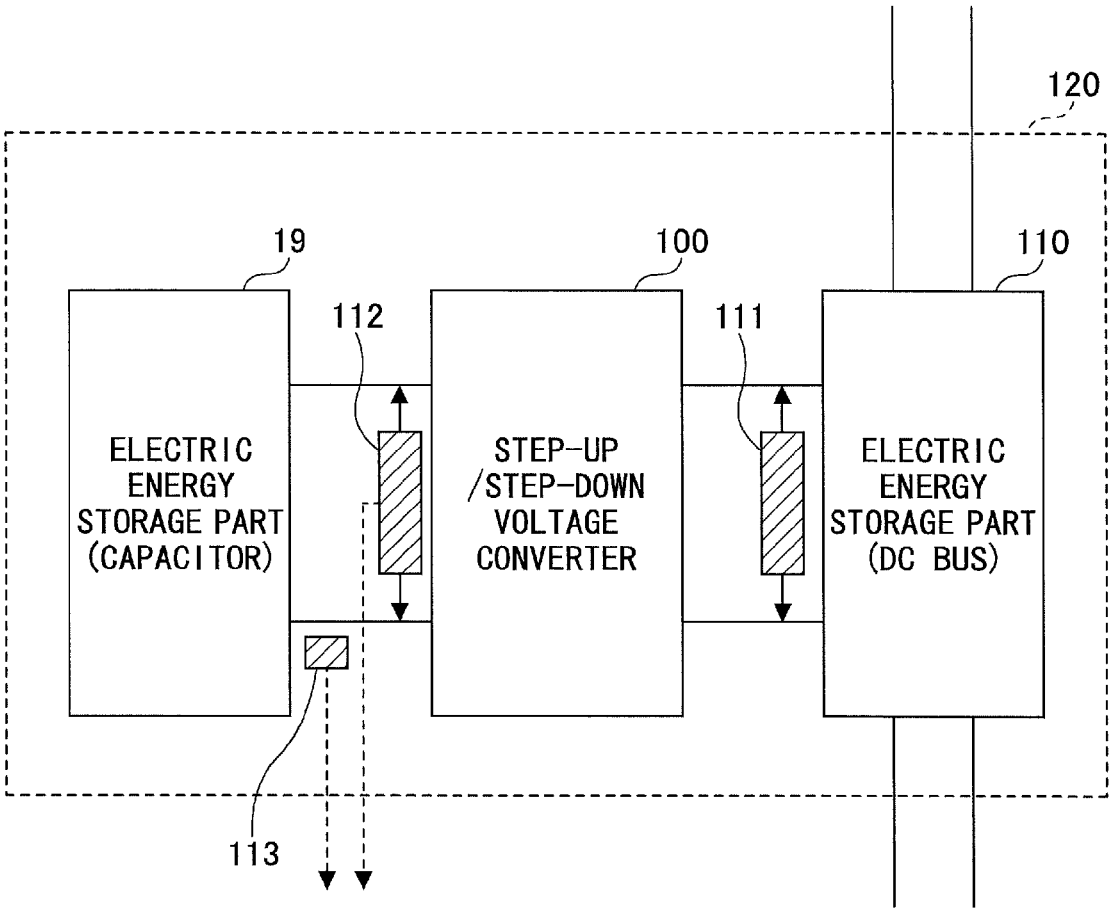
FIG. 4 is a block diagram showing a configuration example of an electric energy storage system of the hybrid type shovel according to an embodiment of the present invention.

FIG. 4 is a block diagram showing a configuration example of the electric energy storage system 120. The electric energy storage system 120 includes a capacitor 19, a step-up/step-down voltage converter 100, and a DC bus 110. The capacitor 19 is provided with a capacitor voltage detecting part 112 for detecting a capacitor voltage value and a capacitor current detecting part 113 for detecting a capacitor current value. The capacitor voltage value detected by the capacitor voltage detecting part 112 and the capacitor current value detected by the capacitor current detecting part 113 are supplied to the controller 30.

The step-up/step-down voltage converter 100 is configured to switch between a step-up operation and a step-down operation depending on operating conditions of the electric motor generator 12, the swing-body-driving electric motor 21, and the electric generator 300 so that a DC bus voltage value falls within a certain range. The DC bus 110 is arranged between the step-up/step-down voltage converter 100 and the inverters 18A, 18C, and 20. The DC bus 110 allows electric power to be exchanged among the capacitor 19, the electric motor generator 12, the swing-body-driving electric motor 21, and the electric generator 300.

Here again, referring to FIG. 3, the controller 30 will be explained in detail. The controller 30 is a control device as a main controlling part configured to perform drive control of the hybrid type shovel. The controller 30 includes a processing unit including a Central Processing Unit (CPU) and an internal memory. The CPU executes a drive control program stored in the internal memory.

The controller 30 translates a signal supplied from the pressure sensor 29 into a swing speed command, and performs a drive control of the swing-body-driving electric motor 21. In this case, the signal supplied from the pressure sensor 29 corresponds to a signal representing an amount of manipulation when the manipulation device 26 (a swing manipulating lever) is manipulated to swing the swing mechanism 2.

Also, the controller 30 performs charge/discharge control of the capacitor 19 by performing the drive control of the step-up/step-down voltage converter 100 as a step-up/step-down voltage controlling part as well as performs operation control of the electric motor generator 12 (a switchover between an electrically driven (assist) operation and an electricity generating operation). Specifically, the controller 30 performs switchover control between the step-up operation and the step-down operation of the step-up/step-down voltage converter 100 based on a charging condition of the capacitor 19, an operating condition (whether it is in the electrically driven (assist) operation or in the electricity generating operation) of the electric motor generator 12, an operating condition (whether it is in the power running operation or in the regenerating operation) of the swing-body-driving electric motor 21, and an operating condition of the electric generator 300. In this way, the controller 30 performs the charge/discharge control of the capacitor 19.

The switchover control between the step-up operation and the step-down operation of the step-up/step-down voltage converter 100 is performed based on a DC bus voltage value detected by a DC bus voltage detecting part 111, a capacitor voltage value detected by the capacitor voltage detecting part 112, and a capacitor current value detected by the capacitor current detecting part 113.

In the above configuration, the electric power generated by the electric motor generator 12 as an assist motor is supplied to the DC bus 110 of the electric energy storage system 120 via the inverter 18A, and supplied to the capacitor 19 via the step-up/step-down voltage converter 100. Also, the regenerative electric power regenerated through the regenerative operation of the swing-body-driving electric motor 21 is supplied to the DC bus 110 of the electric energy storage system 120 via the inverter 20, and supplied to the capacitor 19 via the step-up/step-down voltage converter 100. Also, the electric power generated by the boom-regenerating electric generator 300 is supplied to the DC bus 110 of the electric energy storage system 120 via the inverter 18C, and supplied to the capacitor 19 via the step-up/step-down voltage converter 100. The electric power generated by the electric motor generator 12 or the electric generator 300 may be supplied directly to the swing-body-driving electric motor 21 via the inverter 20. Also, the electric power generated by the swing-body-driving electric motor 21 or the electric generator 300 may be supplied directly to the electric motor generator 12 via the inverter 18A.

The capacitor 19 may be any of rechargeable electric energy storage devices that allow the electric power to be exchanged with the DC bus 110 via the step-up/step-down voltage converter 100. In this regard, FIG. 4 shows the capacitor 19 as an electric energy storage device. However, instead of the capacitor 19, a rechargeable secondary battery such as a lithium-ion battery, a lithium-ion capacitor, or other forms of electric source that allow electric power to be exchanged may be used as an electric energy storage device.

In addition to the above functions, the controller 30 also performs drive control of the communication circuit 320 depending on operating conditions of the hydraulic actuators and pressure conditions of the hydraulic oil in the hydraulic actuators.

Figure 5:
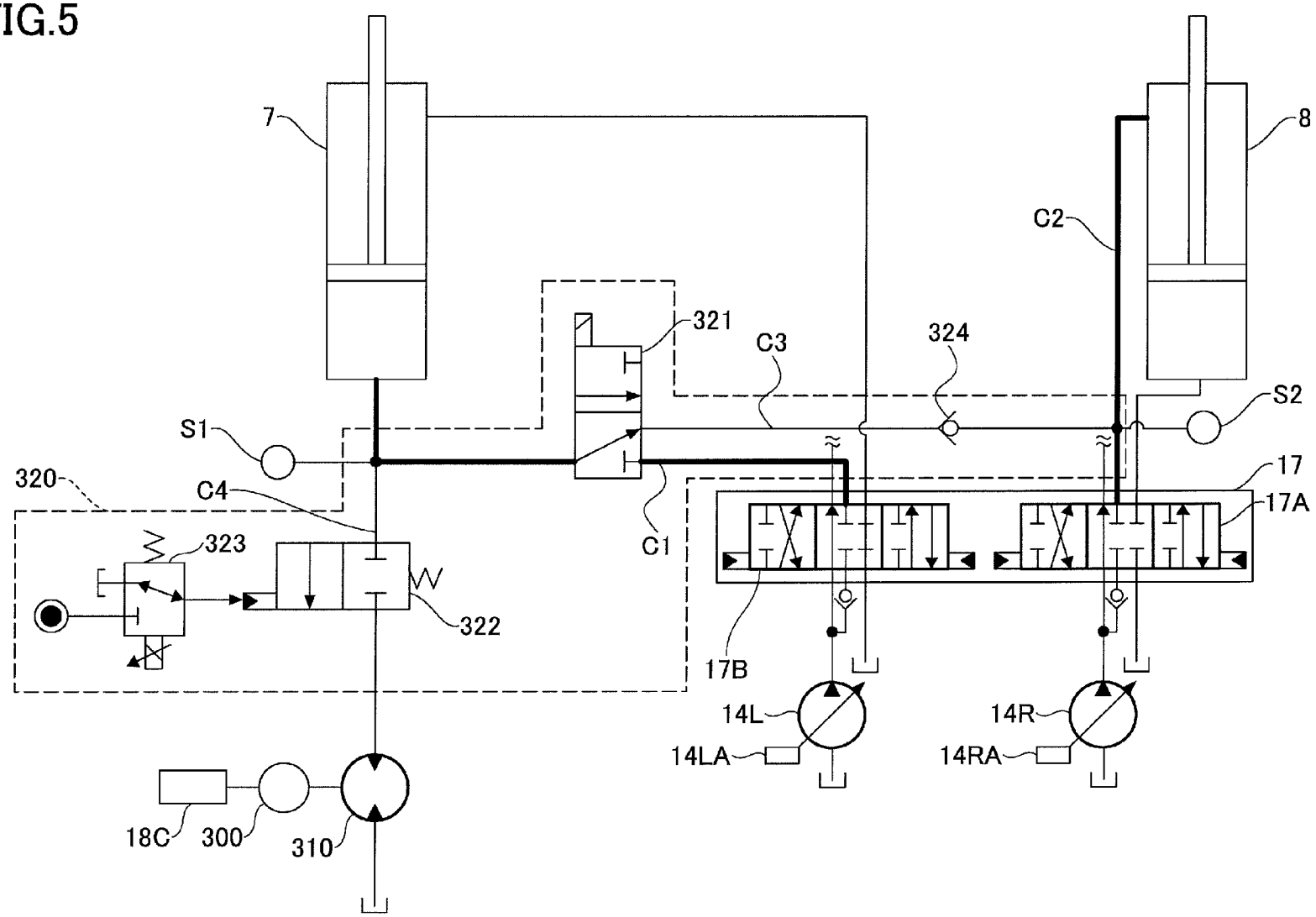
FIG. 5 is a diagram showing a configuration example of a hydraulic communication circuit in the hybrid type shovel according to an embodiment of the present invention.

Here, referring to FIG. 5, the communication circuit 320 will be explained in detail. FIG. 5 is a diagram showing a configuration example of the communication circuit 320. In this embodiment, the communication circuit 320 is arranged to connect the bottom side oil chamber of the boom cylinder 7, the rod side oil chamber of the arm cylinder 8, the control valve 17, and the hydraulic motor 310.

The communication circuit 320 includes a reusing flow control valve 321, a regenerating flow control valve 322, an electromagnetic valve 323, and a check valve 324.

The reusing flow control valve 321 controls flow rate of hydraulic oil flowing in a reusing oil passage C3 that connects a boom cylinder bottom side oil passage C1 (highlighted by a thick line) and an arm cylinder rod side oil passage C2

(equally highlighted by a thick line). In this embodiment, the reusing flow control valve 321 is, for example, an electromagnetic spool valve with 3 ports and 2 positions. The boom cylinder bottom side oil passage C1 connects the bottom side oil chamber of the boom cylinder 7 and a boom-driving flow control valve 17B of the control valve 17. Also, the arm cylinder rod side oil passage C2 connects the rod side oil chamber of the arm cylinder 8 and an arm-driving flow control valve 17A of the control valve 17.

In this embodiment, one end of the reusing oil passage C3 is connected to the arm cylinder rod side oil passage C2. The reusing oil passage C3 may be connected to an oil passage that connects the bottom side oil chamber of the arm cylinder 8 and the arm-driving flow control valve 17A of the control valve 17. In this case, hydraulic oil flowing out of the bottom side oil chamber of the boom cylinder 7 can flow into the bottom side oil chamber of the arm cylinder 8, and thus can be used for an arm closing operation. Also, the reusing oil passage C3 may be connected to an oil passage that connects the main pumps 14L, 14R and the control valve 17, i.e., may be connected to upstream of the control valve 17. In this case, hydraulic oil flowing out of the bottom side oil chamber of the boom cylinder 7 can be used for hydraulic actuators other than the arm cylinder 8.

The regenerating flow control valve 322 controls a flow rate of hydraulic oil flowing in a regenerating oil passage C4 that connects the boom cylinder bottom side oil passage C1 and the hydraulic motor 310. In this embodiment, the regenerating flow control valve 322 is, for example, a spool valve with 2 ports and 2 positions.

The electromagnetic valve 323 controls the regenerating flow control valve 322. In this embodiment, for example, the electromagnetic valve 323 selectively exerts a control pressure generated by a pilot pump on a pilot port of the regenerating flow control valve 322.

The check valve 324 is arranged in the reusing oil passage C3, and prevents hydraulic oil from flowing from the arm cylinder rod side oil passage C2 to the boom cylinder bottom side oil passage C1.

Figure 6:
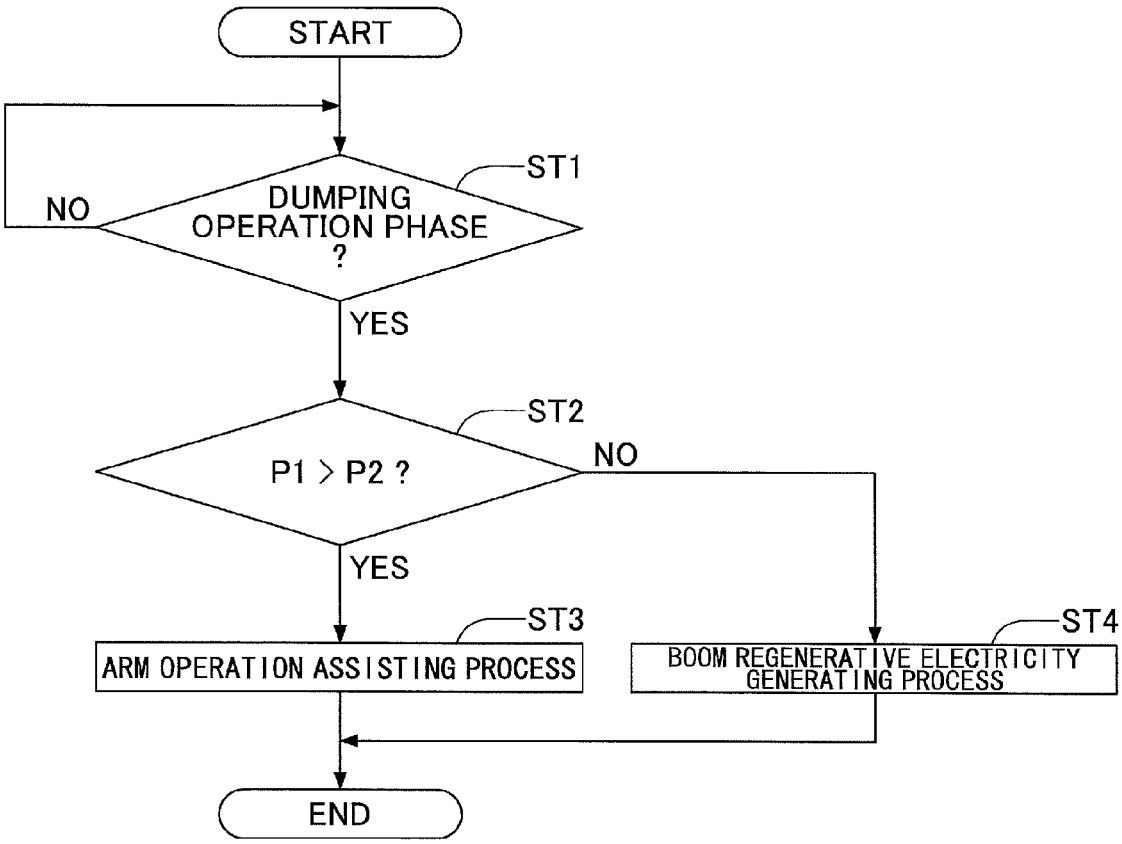
FIG. 6 is a flowchart showing a flow of a communication circuit driving process.

Here, referring to FIG. 6, a process will be explained in which the controller 30 controls a flow of hydraulic oil in the communication circuit 320 (hereinafter referred to as "communication circuit driving process"). FIG. 6 is a flowchart showing a flow of the communication circuit driving process. The controller 30 performs this communication circuit driving process repeatedly at predetermined control periods during operation of the shovel.

First, the controller 30 detects amounts of manipulation of a boom manipulating lever and an arm manipulating lever based on outputs of the pressure sensor 29. Then, the controller 30 determines whether it is in the dumping operation phase, i.e., whether a boom lowering operation and an arm opening operation are being performed simultaneously (step ST1). To determine whether it is in the dumping operation phase, the controller 30 may determine whether a boom lowering operation, an arm opening operation, and a bucket opening operation are being performed simultaneously. Also, the controller 30 may determine whether it is in the dumping operation phase based on outputs of angle sensors (not shown) or displacement sensors (not shown). The angle sensors detect pivot angles of the boom 4, the arm 5, and the bucket 6. The displacement sensors detect displacements of the boom cylinder 7, the arm cylinder 8, and the bucket cylinder 9.

If the controller 30 determines that it is not in the dumping operation phase, i.e., that the boom lowering operation and the arm opening operation are not being performed simultaneously (NO in step ST1), the controller 30 keeps on monitoring the outputs of the pressure sensor 29 until the controller 30 determines that it is in the dumping operation phase.

If the controller 30 determines that it is in the dumping operation phase, i.e., that the boom lowering operation and the arm opening operation are being performed simultaneously (YES in step ST1), the controller 30 compares a pressure P1 detected by the boom cylinder pressure sensor S1 and a pressure P2 detected by the arm cylinder pressure sensor S2 (step ST2).

If the detected pressure P1 is greater than the detected pressure P2, i.e., if the pressure of the hydraulic oil in the bottom side oil chamber of the boom cylinder 7 is greater than the pressure of the hydraulic oil in the rod side oil chamber of the arm cylinder 8 (YES in step ST2), the controller 30 performs an arm operation assisting process (step ST3).

Specifically, the controller 30 outputs a predetermined control signal to the reusing flow control valve 321 and the electromagnetic valve 323 in the communication circuit 320. Then, the controller 30 causes the hydraulic oil flowing out of the bottom side oil chamber of the boom cylinder 7 to flow into the rod side oil chamber of the arm cylinder 8.

Also, the controller 30 controls a discharge rate of the main pump 14R by outputting a predetermined control signal to a regulator 14RA. Then, the controller 30 allows hydraulic oil to be supplied to the rod side oil chamber of the arm cylinder 8 at a desired flow rate by using the hydraulic oil flowing out of the bottom side oil chamber of the boom cylinder 7 and hydraulic oil discharged from the main pump 14R. Specifically, the controller 30 determines a flow rate of hydraulic oil to be discharged from the main pump 14R based on the pressure P1 detected by the boom cylinder pressure sensor S1 and the pressure P2 detected by the arm cylinder pressure sensor S2.

In this way, the controller 30 allows hydraulic energy of the hydraulic oil flowing out of the boom cylinder 7 in the dumping operation phase to be used for the arm opening operation without converting the hydraulic energy into electric energy. As a result, the controller 30 can make more efficient use of the hydraulic oil that had been drained to the oil tank after rotating the hydraulic motor 310 as before.

In contrast, if the detected pressure P1 is lower than or equal to the detected pressure P2, i.e., if the pressure of the hydraulic oil in the bottom side oil chamber of the boom cylinder 7 is lower than or equal to the pressure of the hydraulic oil in the rod side oil chamber of the arm cylinder 8 (NO in step ST2), the controller 30 performs a boom regenerative electricity generating process (step ST4).

Specifically, the controller 30 outputs a predetermined control signal to the reusing flow control valve 321 and the electromagnetic valve 323 in the communication circuit 320. Then, the controller 30 causes the hydraulic oil flowing out of the bottom side oil chamber of the boom cylinder 7 to flow into the hydraulic motor 310, and causes the electric generator 300 to generate electricity.

This is because the pressure of the hydraulic oil in the rod side oil chamber of the arm cylinder 8 is greater than the pressure of the hydraulic oil in the bottom side oil chamber of the boom cylinder 7, and because it is impossible to cause the hydraulic oil flowing out of the bottom side oil chamber of the boom cylinder 7 to flow into the rod side oil chamber of the arm cylinder 8.

The controller 30 may supply a part of the hydraulic oil flowing out of the boom cylinder 7 to the arm cylinder 8, and may cause the remaining part of the hydraulic oil flowing out of the boom cylinder 7 to flow into the hydraulic motor 310. This is to make best use of the hydraulic energy of the hydraulic oil flowing out of the boom cylinder 7 even if a flow rate of the hydraulic oil flowing out of the boom cylinder 7 is greater than a flow rate of hydraulic oil required for the arm opening operation in the arm operation assisting process.

Also, even if the boom lowering operation and the arm opening operation or a bucket opening operation are not being performed simultaneously, the controller 30 performs the boom regenerative electricity generating process if the boom lowering operation is being performed. This is to make best use of the hydraulic energy of the hydraulic oil flowing out of the boom cylinder 7.

Also, in this embodiment, the controller 30 allows the hydraulic oil flowing out of the boom cylinder 7 to be used for the arm opening operation. However, the hydraulic oil may be used for an arm closing operation, a bucket closing operation, a bucket opening operation, or a traveling of the lower travel body 1.

Figure 7:
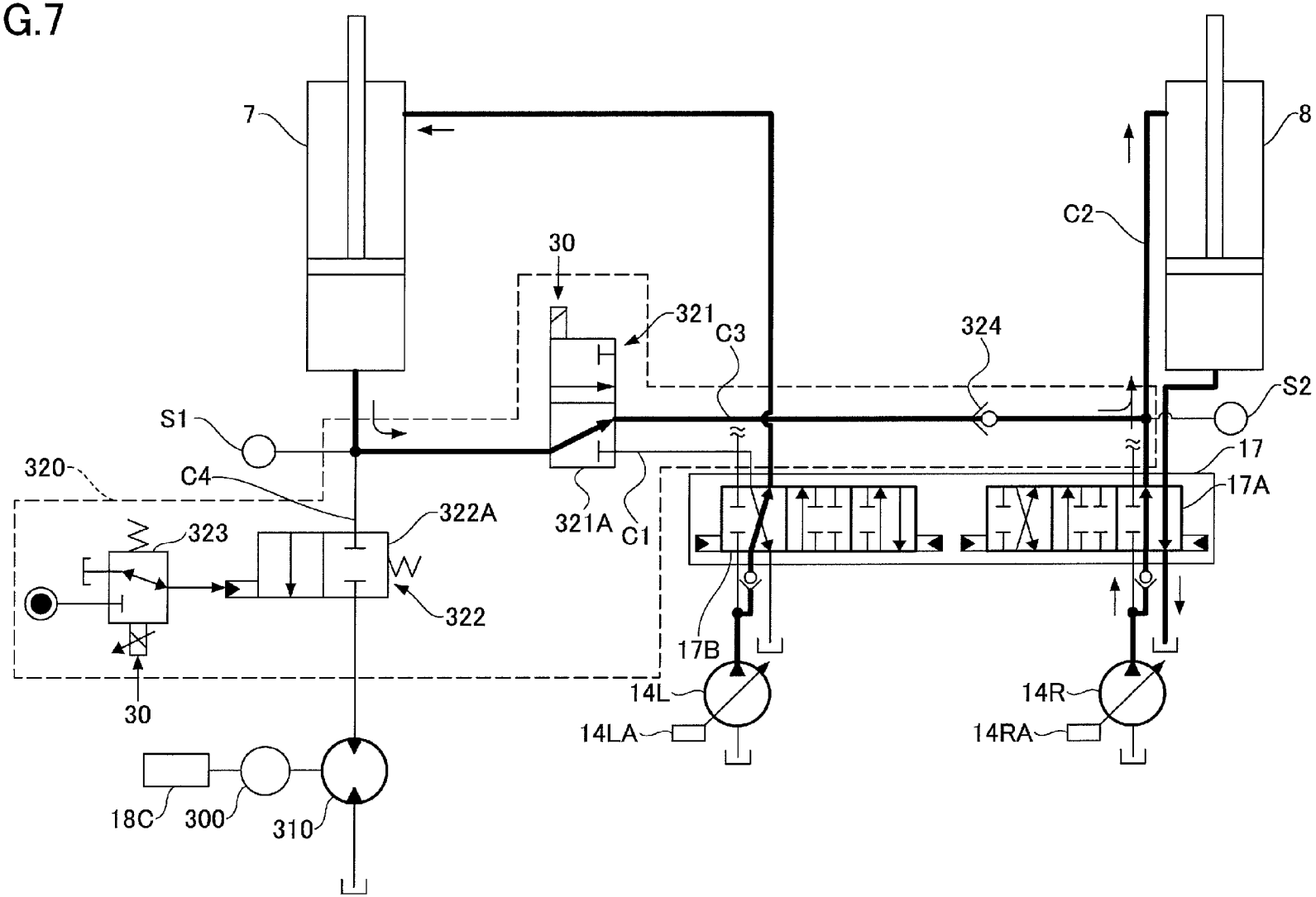
FIG. 7 is a diagram showing a state of the communication circuit in an arm operation assisting process.
Figure 8:
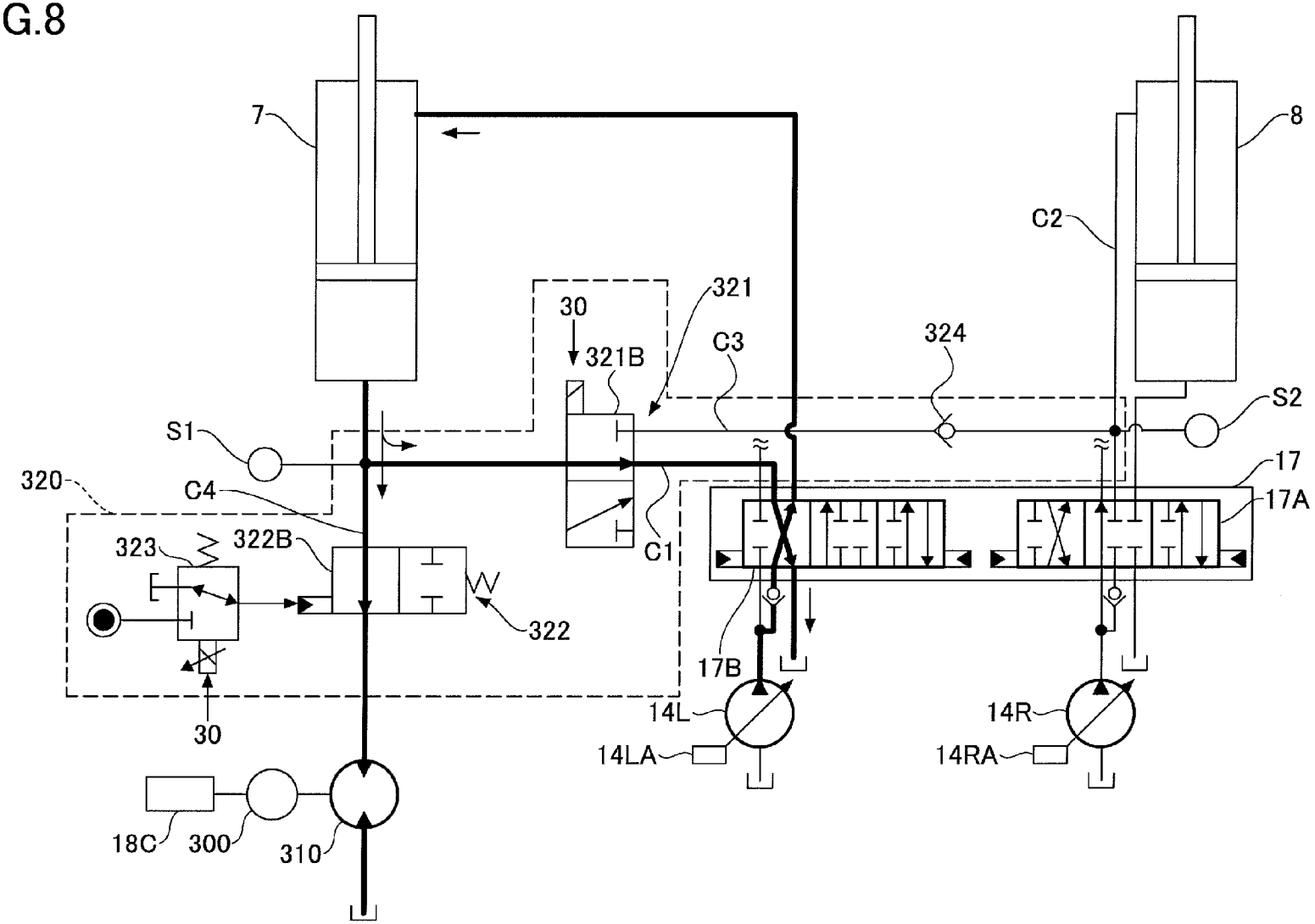
FIG. 8 is a diagram showing a state of the communication circuit in a boom regenerative electricity generating process.

Here, referring to FIGS. 7 and 8, there will be explained in detail an operation of the communication circuit 320 in the arm operation assisting process and the boom regenerative electricity generating process. FIG. 7 shows a state of the communication circuit 320 in the arm operation assisting process. FIG. 8 shows a state of the communication circuit 320 in the boom regenerative electricity generating process. Also, thick solid lines in FIGS. 7 and 8 indicate that there is a flow of hydraulic oil.

FIG. 7 shows a state where hydraulic oil discharged from the main pump 14L flows into the rod side oil chamber of the boom cylinder 7, hydraulic oil discharged from the main pump 14R flows into the rod side oil chamber of the arm cylinder 8, and a boom lowering operation and an arm opening operation are being performed simultaneously. In FIG. 7, a pressure P1 detected by the boom cylinder pressure sensor S1 is greater than a pressure P2 detected by the arm cylinder pressure sensor S2.

In the state like this, the reusing flow control valve 321 switches its valve position to a first valve position 321A in response to a control signal from the controller 30. As a result, a flow of hydraulic oil from the boom cylinder 7 to the control valve 17 is closed off. Hydraulic oil flowing out of the boom cylinder 7 reaches the arm cylinder rod side oil passage C2 through the reusing oil passage C3, joins together with hydraulic oil discharged from the main pump 14R, and flows into the rod side oil chamber of the arm cylinder 8.

Also, the electromagnetic valve 323 switches a valve position of the regenerating flow control valve 322 to a first valve position 322A in response to a control signal from the controller 30. As a result, a flow of hydraulic oil from the boom cylinder 7 to the hydraulic motor 310 is closed off, and all of the hydraulic oil flowing out of the boom cylinder 7 flow into the rod side oil chamber of the arm cylinder 8.

Also, the controller 30 outputs a control signal to the regulator 14RA, decreases a discharge rate of the main pump 14R, and decreases a flow rate of hydraulic oil flowing from the main pump 14R to the rod side oil chamber of the arm cylinder 8. Also, the controller 30 may decrease or eliminate a flow rate of the hydraulic oil flowing from the main pump 14R to the rod side oil chamber of the arm cylinder 8 by controlling the arm-driving flow control valve 17A. In the case where the controller 30 has eliminated the flow rate of the hydraulic oil flowing from the main pump 14R to the rod side oil chamber of the arm cylinder 8, only the hydraulic oil flowing out of the bottom side oil chamber of the boom cylinder 7 is supplied to the rod side oil chamber of the arm cylinder 8.

In this way, the communication circuit 320 causes all of the hydraulic oil flowing out of the boom cylinder 7 to flow into the rod side oil chamber of the arm cylinder 8 if a boom lowering operation and an arm opening operation are performed simultaneously and if the detected pressure P1 is greater than the detected pressure P2.

Also, FIG. 8 shows a state where hydraulic oil discharged from the main pump 14L flows into the rod side oil chamber of the boom cylinder 7, and only a boom lowering operation is being performed.

In a state like this, the reusing flow control valve 321 switches its valve position to a second valve position 321B in response to a control signal from the controller 30. As a result, a flow of hydraulic oil from the boom cylinder 7 to the arm cylinder 8 is closed off. A part of the hydraulic oil flowing out of the boom cylinder 7 reaches the control valve 17 through the boom cylinder bottom side oil passage Cl, and then is drained to the oil tank through the control valve 17.

Also, the electromagnetic valve 323 switches a valve position of the regenerating flow control valve 322 to a second valve position 322B in response to a control signal from the controller 30. As a result, a remaining part of the hydraulic oil flowing out of the boom cylinder 7 flows into the hydraulic motor 310, rotates the hydraulic motor 310 and the electric generator 300, and then is drained to the oil tank.

In this way, if the boom lowering operation is being singularly performed, the communication circuit 320 causes a part of the hydraulic oil flowing out of the boom cylinder 7 to flow into the hydraulic motor 310, and causes the electric generator 300 to generate electricity. The controller 30 may cause all of the hydraulic oil flowing out of the boom cylinder 7 to flow into the hydraulic motor 310.

Figure 9:
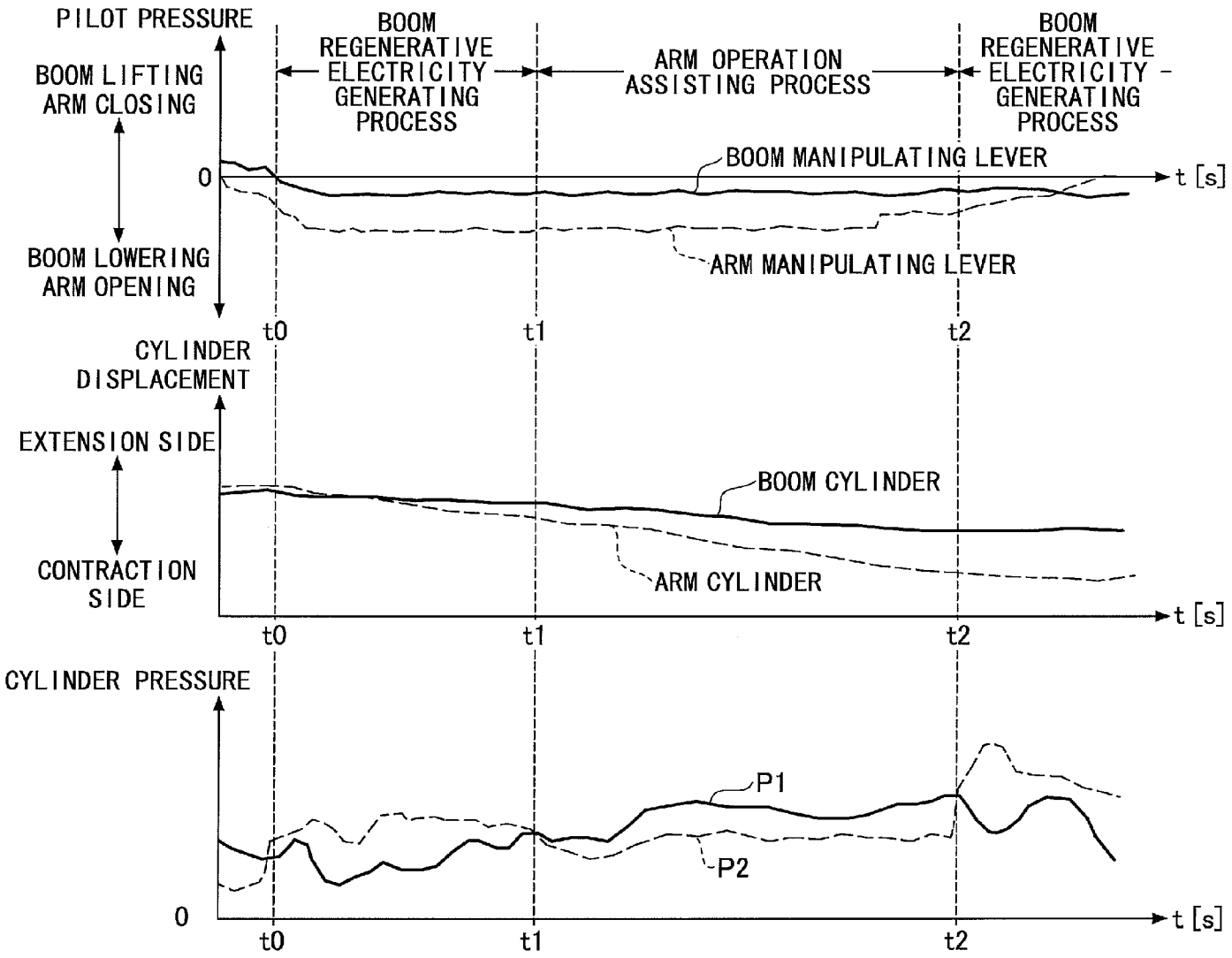
FIG. 9 is a diagram showing a temporal transition of various physical quantities when a controller performs the arm operation assisting process or the boom regenerative electricity generating process in a dumping operation phase.

Next, referring to FIG. 9, temporal changes will be explained in each of a pilot pressure (see an upper graph of FIG. 9), a cylinder displacement (see a central graph of FIG. 9), and a cylinder pressure (see a lower graph of FIG. 9) when the controller 30 performs the arm operation assisting process or the boom regenerative electricity generating process in the dumping operation phase. Trends indicated by solid lines in each of the upper graph, the central graph, and the lower graph of FIG. 9 represent changes in a pilot pressure of the boom manipulating lever, a displacement of the boom cylinder 7, and a pressure of the hydraulic oil in the bottom side oil chamber of the boom cylinder 7 (a pressure P1 detected by the boom cylinder pressure sensor S1), respectively. Also, trends indicated by dashed lines in each of the upper graph, the central graph, and the lower graph of FIG. 9 represent changes in a pilot pressure of the arm manipulating lever, a displacement of the arm cylinder 8, and a pressure of the hydraulic oil in the rod side oil chamber of the arm cylinder 8 (a pressure P2 detected by the arm cylinder pressure sensor S2), respectively.

In a time point t0, if the boom manipulating lever is manipulated in a lowering direction and if a pilot pressure in the lowering direction of the boom manipulating lever increases, the controller 30 performs the boom regenerative electricity generating process and puts the communication circuit 320 into the state in FIG. 8. This is because the hydraulic energy of the hydraulic oil flowing out of the boom cylinder 7 due to the boom lowering operation becomes available, and because it is impossible to perform the arm operation assisting process due to the fact that the detected pressure P1 is lower than or equal to the detected pressure P2. At this point in time, the arm manipulating lever has already been manipulated in an opening direction, and the pilot pressure in the opening direction of the arm manipulating lever has already become greater than or equal to a predetermined level.

By the above manipulation, the boom cylinder 7 is slowly displaced toward a contraction side and operates to lower the boom 4, and the arm cylinder 8 is displaced toward a contraction side and operates to open the arm 5. The controller 30 may determine a start timing of the arm operation assisting process or the boom regenerative electricity generating process based on such displacements of the boom cylinder 7 and the arm cylinder 8.

Subsequently, if the detected pressure P1 becomes greater than the detected pressure P2 at a time point t1, the controller 30 stops the boom regenerative electricity generating process. Then, the controller 30 performs the arm operation assisting process and puts the communication circuit 320 into the state in FIG. 7. This is because it has become possible to cause the hydraulic oil flowing out of the boom cylinder 7 to flow into the arm cylinder 8 due to the fact that the detected pressure P1 has become greater than the detected pressure P2.

Even if the controller 30 performs the arm operation assisting process, the controller 30 may keep on performing the boom regenerative electricity generating process by using a part of the hydraulic oil flowing out of the boom cylinder 7. In that case, the reusing flow control valve 321 is set to the first valve position 321A, and the regenerating flow control valve 322 is set to the second valve position 322B.

Subsequently, if the detected pressure P1 becomes lower than the detected pressure P2 again at a time point t2, the controller 30 stops the arm operation assisting process. Then, the controller 30 performs the boom regenerative electricity generating process and puts the communication circuit 320 into the state in FIG. 8 again. This is because it is impossible to perform the arm operation assisting process due to the fact that the detected pressure P1 has become lower than or equal to the detected pressure P2.

By the above configuration, the hybrid type shovel according to this embodiment can make use of the hydraulic energy of the hydraulic oil flowing out of the boom cylinder 7 during a boom lowering operation for operations of other hydraulic actuators without converting it into electric energy. Thus, it is possible to make more efficient use of the hydraulic oil flowing out of the boom cylinder 7 during a boom lowering operation.

Also, the hybrid type shovel according to this embodiment confirms that the pressure of the hydraulic oil in the boom cylinder 7 is greater than the pressure of the hydraulic oil in other hydraulic actuator as a prospective supply destination of the hydraulic oil. On that basis, the hybrid type shovel according to this embodiment causes the hydraulic oil flowing out of the boom cylinder 7 to flow into the other hydraulic actuator as the prospective supply destination. In contrast, if the pressure of the hydraulic oil in the boom cylinder 7 is lower than the pressure of the hydraulic oil in the other hydraulic actuator as the prospective supply destination of the hydraulic oil, the hybrid type shovel according to this embodiment closes off an oil passage between the boom cylinder 7 and the other hydraulic actuator as the prospective supply destination. Thus, it is possible to cause the hydraulic oil flowing out of the boom cylinder 7 to reliably flow into the other hydraulic actuator as the prospective supply destination.

Also, the hybrid type shovel according to this embodiment confirms that the other hydraulic actuator as the prospective supply destination of the hydraulic oil flowing out of the boom cylinder 7 is in operation. On that basis, the hybrid type shovel according to this embodiment causes the hydraulic oil flowing out of the boom cylinder 7 to flow into the other hydraulic actuator as the prospective supply destination. In contrast, if the other hydraulic actuator as the prospective supply destination is not in operation, the hybrid type shovel according to this embodiment causes the hydraulic oil flowing out of the boom cylinder 7 to flow into the hydraulic motor 310, and causes the electric generator 300 to generate electricity. Thus, the hybrid type shovel according to this embodiment can make efficient and reliable use of the hydraulic oil flowing out of the boom cylinder 7 depending on operating conditions of the other hydraulic actuator as the prospective supply destination.

Next, referring to FIG. 10, a shovel according to another embodiment of the present invention will be explained.

Figure 10:
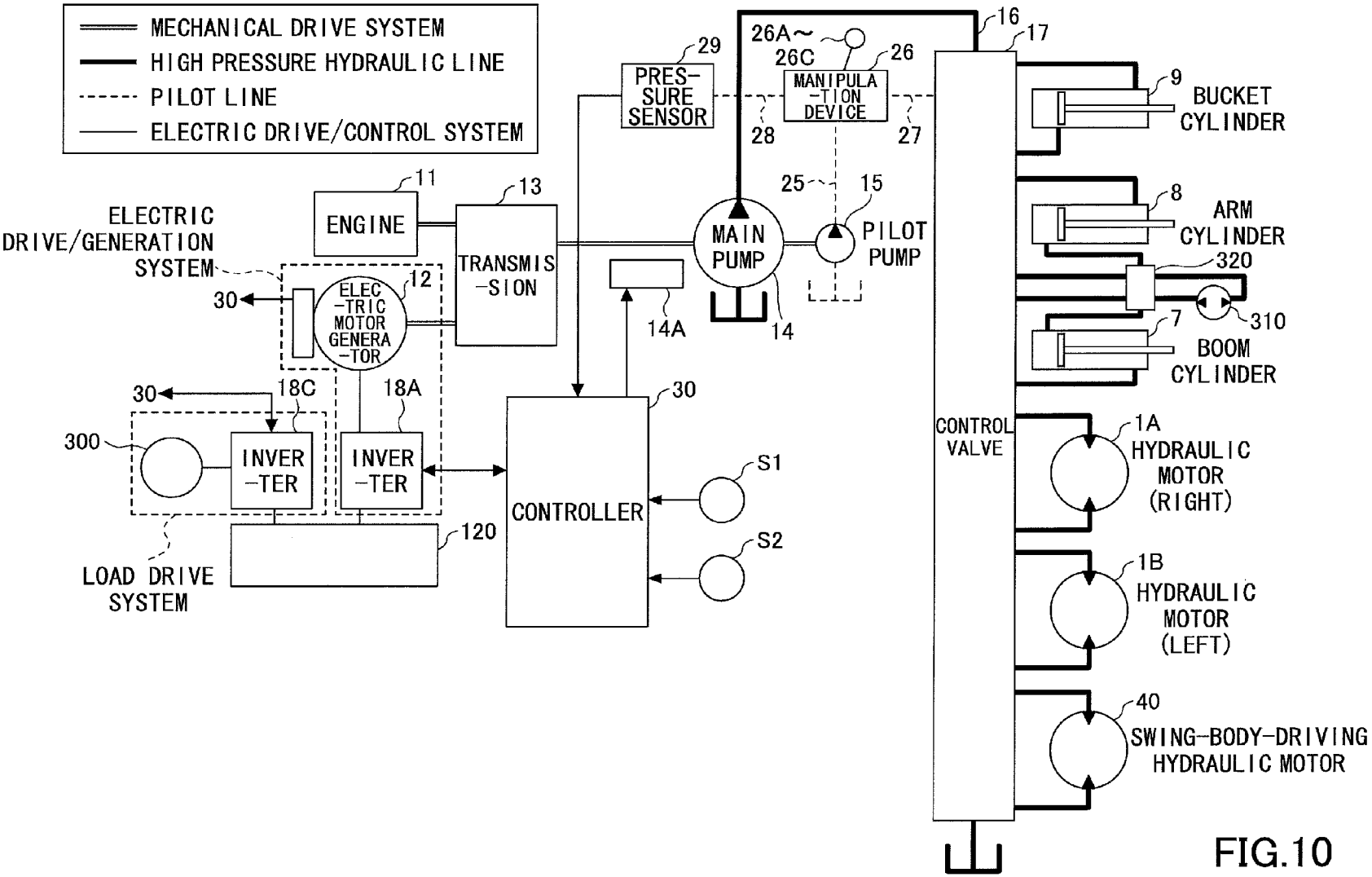
FIG. 10 is a block diagram showing a configuration example of a drive system of another embodiment of the present invention.

FIG. 10 is a block diagram showing a configuration example of the shovel according to another embodiment of the present invention. As in FIG. 3, FIG. 10 indicates a mechanical drive system by a double line, a high pressure hydraulic line by a thick solid line, a pilot line by a dashed line, and an electric drive/control system by a thin solid line.

The shovel according to this embodiment is different from the hybrid type shovel according to the foregoing embodiment in that it includes a swing-body-driving hydraulic motor 40 instead of the first load drive system as an electrically-driven swing mechanism. However, the shovel is the same as the hybrid type shovel in other aspects. By this configuration, the shovel according to this embodiment can achieve the same effect as the hybrid type shovel according to the foregoing embodiment.

While certain preferred embodiments of the present invention have been described above, the present invention is not limited to these embodiments, and various changes and substitutions may be made without departing from the scope of the present invention.

For example, in the above embodiments, the reusing flow control valve 321 and the regenerating flow control valve 322 are configured as two individually independent spool valves. However, they may be configured as a single spool valve.

What is claimed is:

1. A shovel including a plurality of hydraulic actuators including a boom cylinder, comprising:

a hydraulic motor driven by hydraulic oil flowing out of the boom cylinder;

a regenerating oil passage configured to supply the hydraulic oil flowing out of the boom cylinder to the hydraulic motor;

a reusing oil passage configured to supply the hydraulic oil flowing out of the boom cylinder to another hydraulic actuator;

a reusing flow control valve configured to control a flow rate of hydraulic oil flowing in the reusing oil passage;

a boom cylinder pressure sensor configured to detect pressure of hydraulic oil in the boom cylinder; and a hydraulic actuator pressure sensor configured to detect pressure of hydraulic oil in the other hydraulic actuator, wherein the reusing flow control valve, which is a switching valve configured to switch between an opening and a closing of the reusing oil passage, opens the reusing oil passage when the pressure of the hydraulic oil in the boom cylinder is greater than the pressure of the hydraulic oil in the other hydraulic actuator.

2. The shovel as claimed in claim 1, further comprising:

an operating condition detecting part configured to detect operating conditions of the other hydraulic actuator, wherein the reusing flow control valve opens the reusing oil passage if the other hydraulic actuator is in operation.

3. The shovel as claimed in claim 1, wherein the other hydraulic actuator is an arm cylinder.

4. A shovel including a plurality of hydraulic actuators including a boom cylinder, comprising:

a hydraulic motor driven by hydraulic oil flowing out of the boom cylinder;

a regenerating oil passage configured to supply the hydraulic oil flowing out of the boom cylinder to the hydraulic motor;

a reusing oil passage configured to supply the hydraulic oil flowing out of the boom cylinder to another hydraulic actuator;

a reusing flow control valve configured to control a flow rate of hydraulic oil flowing in the reusing oil passage;

a boom cylinder pressure sensor configured to detect pressure of hydraulic oil in the boom cylinder; and a hydraulic actuator pressure sensor configured to detect pressure of hydraulic oil in the other hydraulic actuator, wherein the reusing flow control valve closes the reusing oil passage if the pressure of the hydraulic oil in the boom cylinder is lower than the pressure of the hydraulic oil in the other hydraulic actuator.

5. The shovel as claimed in claim 4, further comprising:

an operating condition detecting part configured to detect operating conditions of the other hydraulic actuator, wherein the reusing flow control valve opens the reusing oil passage if the other hydraulic actuator is in operation.

6. The shovel as claimed in claim 4, wherein the other hydraulic actuator is an arm cylinder.

7. A shovel including a plurality of hydraulic actuators including a boom cylinder, comprising:

a hydraulic motor driven by hydraulic oil flowing out of the boom cylinder;

a regenerating oil passage configured to supply the hydraulic oil flowing out of the boom cylinder to the hydraulic motor;

a reusing oil passage configured to supply the hydraulic oil flowing out of the boom cylinder to another hydraulic actuator;

a reusing flow control valve configured to control a flow rate of hydraulic oil flowing in the reusing oil passage;

an operating condition detecting part configured to detect operating conditions of the other hydraulic actuator, and a regenerating electric generator connected to the hydraulic motor, wherein the regenerating electric generator generates electricity if the other hydraulic actuator is not in operation.

8. The shovel as claimed in claim 7, wherein the reusing flow control valve opens the reusing oil passage if the other hydraulic actuator is in operation.

9. The shovel as claimed in claim 7, wherein the other hydraulic actuator is an arm cylinder.

* * * * *